United States Patent [19]

Stofko

[11] 4,409,170

[45] Oct. 11, 1983

[54] PRODUCTION OF COMPOSITE PRODUCTS BY CONSOLIDATION USING PRESSURE AND CONVECTION HEATING

[75] Inventor: John Stofko, St. Charles, Ill.

[73] Assignee: John Jansky, France

[21] Appl. No.: 336,481

[22] Filed: Dec. 31, 1981

[51] Int. Cl.[3] ..... D04H 1/16

[52] U.S. Cl. ..... 264/113; 156/62.2; 264/122; 264/123; 264/124; 264/126; 425/419; 425/420

[58] Field of Search ..... 264/113, 122, 123, 124, 264/126; 425/419, 420; 156/62.2

[56] References Cited

U.S. PATENT DOCUMENTS

| | | | |
|---|---|---|---|
| 2,557,071 | 6/1951 | Boehm | 154/133 |
| 2,984,578 | 5/1961 | Glab | 106/163 |
| 3,208,864 | 9/1965 | Glab | 106/163 |
| 3,280,237 | 10/1966 | Corbin | 264/109 |
| 3,295,167 | 1/1967 | Corbin | 425/394 |
| 3,619,450 | 11/1971 | Futo | 264/109 |
| 3,686,383 | 8/1972 | MaKinen | 264/120 |
| 4,162,877 | 7/1979 | Nyberg | 425/84 |
| 4,193,814 | 3/1980 | Shen | 106/123 LC |

*Primary Examiner*—Maurice J. Welsh

*Attorney, Agent, or Firm*—Karl W. Flocks; Sheridan Neimark

[57] ABSTRACT

A process and apparatus are provided for pressing fibrous, particulate or laminar materials to provide laminated products of low to medium density. The system is characterized by the use of lightweight pressing plates which have horizontal and vertical permeability, by the sealing of the press to provide a closed environment, and by heating substantially entirely by the use of a fluid heat carrier which heats the materials by convection.

18 Claims, 9 Drawing Figures

FIG. 2.
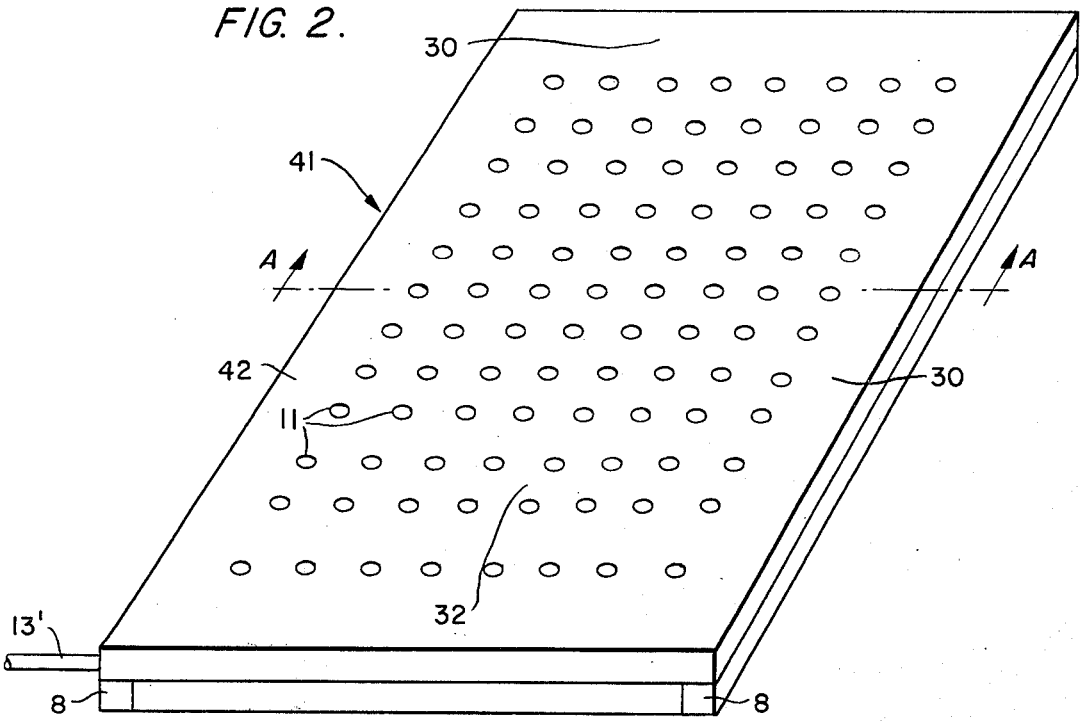
FIG. 2A.
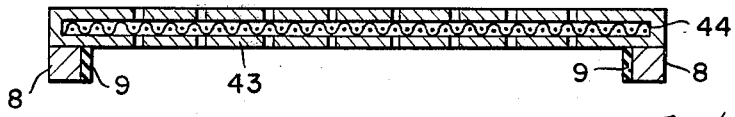
FIG. 3.
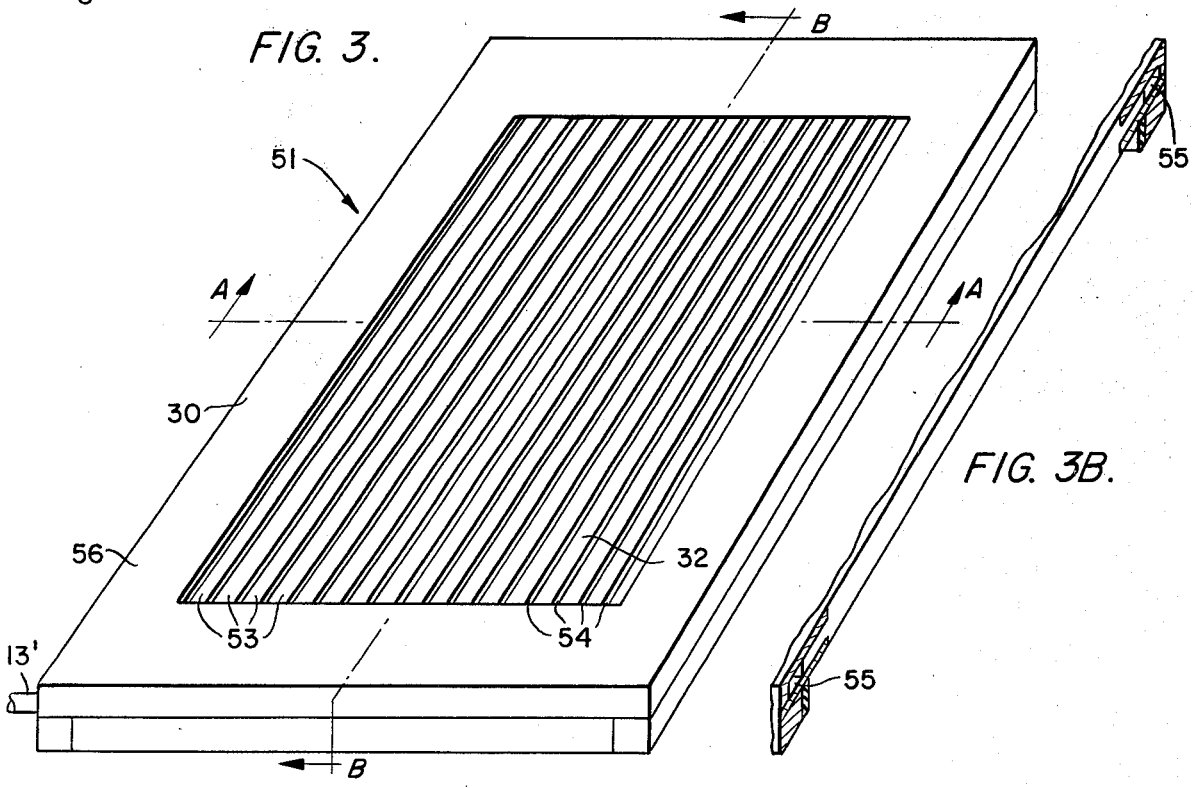
FIG. 3B.
FIG. 3A.
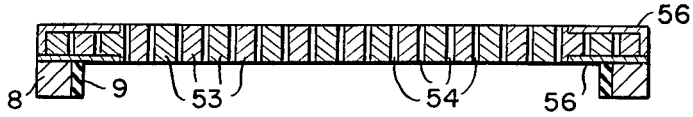

PRODUCTION OF COMPOSITE PRODUCTS BY CONSOLIDATION USING PRESSURE AND CONVECTION HEATING

FIELD OF INVENTION

The present invention relates to the consolidation of fibrous particulate and laminar materials and, more particularly, relates to a method and apparatus for producing consolidated products using pressure and convection heating.

BACKGROUND

Current commercial systems for the consolidation of products using pressure and heat involve the use of massive hydraulic presses based on heat transfer by conduction. Such presses are equipped with thick press platens or plates of high mass and thermal capacity, which are heated by steam or heating oils, passing through a labyrinth of interconnected passageways within the platens. High mass and thermal capacity of the platens is necessary for storing sufficient heat to prevent excessive cooling by cold materials deposited into the press for consolidation. In addition, the pressing platens must be thick also to provide sufficient rigidity which is required to prevent bending deformations of the platens caused by uneven distribution of material to be consolidated over the internal working area of the platens.

The loading of such press platens using conduction heat transfer and open pressing can be viewed as a case where the platens are acted on in a direction perpendicular to the plane of the platen from one side by a nonuniformly distributed load, and from the other side by a nonuniformly distributed elastic support in reaction to the pressure from the first side. Because the distribution of loads and supports is random and may be quite variable, high bending moments may be created which cause a significant deformation of platens during pressing and thereby causing variable thickness of the pressed products. Because such variations cannot be tolerated in commercially produced composite products, the press platens are made 2.5 to 7 inches thick depending on the product.

It has been recognized in the prior art that injecting steam into composite materials during consolidation by pressure and heat produces several improvements, the main one of which is an increase in the curing rate of thermosetting resin adhesives used to consolidate the materials. Several systems have been proposed for this purpose. For example, Futo U.S. Pat. No. 3,619,950 has proposed a gas-tight envelope made of Teflon sheets reinforced in a suitable manner and surrounding press platens with pressed products between them, for the purpose of controlling the ambient atmosphere in and around the products.

Corbin U.S. Pat. No. 3,295,167 shows a steaming apparatus for consolidation of composite products, the apparatus comprising a source of superheated steam which is fed into a plate having a steam chamber and a plurality of spaced openings from such chamber and through which the superheated steam is passed into the product being pressed. The steam passes through and out of the open pressed product to speed up the heat transfer and curing of thermosetting resins.

The patent to Shen, U.S. Pat. No. 3,891,738 discloses press platens which have a chamber and aperture openings on the surface adjacent to the products to be pressed. Steam passes from one press platen through the pressed products into another press platen lying opposite the product, thereby speeding up curing of thermosetting resin adhesives.

The Nyberg patent, U.S. Pat. No. 4,162,877 shows, instead of two, one almost identical press platen as that of Shen with a chamber and aperture openings on the surface coming into contact with the pressed product. Steam is injected from the press platen through the openings into the pressed board and released through the same openings back into the platen after the curing of the thermosetting resin in the pressed product.

All of these aforementioned systems, however, use steam primarily to warm the product being pressed, and the press platens are used for heat transfer simultaneously by conduction, i.e. the products become heated not only from the injected steam by convection, but also from the press platens themselves by conduction in accordance with conventional practice. These devices are accordingly an offshoot of the current commercial systems described above which employ relatively massive presses; therefore, such dual function platens of the aforediscussed patents are too complicated and heavy and too expensive to replace and clean when necessary. In addition, in presses such as shown by Corbin, the steam used is not trapped but is permitted to escape, thereby losing heat and losing control of the adhesive or curing by virtue of uncontrolled steam flow.

In the production of thick products of low and medium density from poor thermal conductors such as wood, fiberglass or porous plastic materials, heat transfer is a major problem. Consolidation times using heat transfer by conduction, which is almost used exclusively in commerce in the present time, are too long and represent a significant cost item.

Another problem which exists in the art relative to wood chips is the loss of heat in the chipping and drying operation. After chipping, the wood particles comprise about 50% water which is far too much for conventional procedures for making particle board and the like; therefore, the wood particles, e.g., fibers, are normally heated to about 400°–450° F. to effect drying thereof. It would be desirable to provide a system in which wetter than normal wood particles can be used, thereby reducing the amount of drying necessary and saving energy.

SUMMARY

It has now been determined that low and medium density products up to about 0.85 specific gravity, e.g. particle board, wafer board and oriented structural board, can be consolidated in a very efficient manner under pressure by the use of heat transferred into the products substantially entirely by convection. A fluid heat carrier, such as high pressure steam, hot air or other hot gas, is injected by force into and/or through the product to be consolidated along the entire surface area of the product, using a quantity of steam or hot gas sufficient to raise the temperature of the product to the desired level, and keeping such hot steam or gas in the product for a sufficient time to complete the consolidation process, after which the gas may be released from the product and the product released from the press.

The simultaneous consolidation with heat transfer is desirably carried out in different ways, depending primarily on the nature of the binder. For example, some binders, such as urea-formaldehyde resin, cure at the boiling temperature of water, e.g. 212° F. (100° C.). For binders of this type where the product to be consolidated needs to be heated up only to temperatures less than about 250° F., the heating fluid can be applied in either of two ways. Thus, superatmospheric steam can be injected into the product to be consolidated from both sides, and it can then be left to expand to atmospheric pressure by condensation of the steam, whereby the heat of condensation is released to heat up the product. Alternatively, superatmospheric steam can be injected into the product to be consolidated through one side and at the moment when it appears on the other side of the product, injection is discontinued because the product has reached the curing temperature. Under ideal conditions of control, there is, at the point of completion of the curing, no steam to be released because heating has been achieved by heat of condensation, the steam having been transformed to water, which increases the moisture content of the product. The heat released under such conditions is sufficient to complete the consolidation process.

On the other hand, if a binder system is used which requires temperatures higher than about 250° F., steam is desirably injected into the product to be consolidated from one side until air in the product is replaced by steam. At that point, steam is desirably injected also through the opposite side of the product and the steam at superatmospheric pressure is injected from both sides until the desired internal steam pressure is reached, it being understood that injection of steam from both sides is desirable because it is faster and achieves better distribution of the heat transfer fluid. Once the desired steam pressure is reached, steam injection is discontinued and the steam is held in the product undergoing consolidation for a time necessary to complete the consolidation. At that point, the steam is released, preferably from both sides because it is faster.

If a heat transfer fluid other than steam is used for the convection heating, it may be desirable to uniformly inject the heated gas along one surface of the product to be consolidated at the appropriate temperature and pressure dependent on the selected binder, and pass the heat carrier out from the opposite surface of the product undergoing consolidation.

The pressing plates for injecting fluid heat carriers into the products to be consolidated in accordance with the present invention are relatively thin plates which are horizontally and vertically permeable to fluids, and are of low mass and thermal capacity. On the other hand, such pressing plates must have sufficient hardness and stiffness to resist the excessive deformation, it being understood that these are far less hard, stiff and massive than are the pressing platens of the prior art. The pressing plates of the present invention, connected to an outside source of fluid heat carrier, serve to distribute the heat carrier uniformly into the product undergoing consolidation by creating a pressure gradient between the source of the fluid heat carrier and the product itself.

Contrary to the prior art where heat is stored in massive platens, pressing platens of the present invention carry out no such function, and therefore are far less massive. The present plates function primarily to provide a distributive passageway for the fluid heat carrier from the outside source into the consolidated product, and also to give some shape during pressing to the product. Therefore, the plates can be made thin and of low mass and thermal capacity. Indeed, it is desirable to make such pressing plates of minimal mass, because then less energy is lost in the useless heating of the plates. If the fluid heat carrier is steam, then, when the mass of the plate is minimized, also less condensation takes place on the surface of the pressing plate at the start of the steam injection.

The conditions during heat transfer by convection are also quite different from the standpoint of the amount of deformation to which the plates are subjected from uneven distribution of the material between them. Thus, during heat transfer by convection, fluid heat carrier such as high pressure steam is injected into the space between the press plates and into all voids of the material to be consolidated, in a short period of time of less than 60 seconds, to reach equilibrium and is there maintained until consolidation has occurred. As a result, the material being acted on and being consolidated becomes pliable, becomes plasticized by heat and moisture throughout its entire volume, and acts in terms of fluid mechanics more like a plastic material with a very small elastic component, and therefore the uneven distribution of the material between the press plates is easily handled without massive press platens because the material being consolidated flows and becomes more evenly distributed, thereby exerting significantly lower pressure at uneven points onto the plates compared with the case of conventional open pressing.

In addition, high steam pressure between press plates produces hydrostatic pressure which acts on both plates. If the elastic reaction pressure of the consolidated material acting on the plate is lower than the steam pressure from the steam source, then both sides of the press plates are under the constant uniformly distributed pressure of the steam, and there can be no deflection of the press plate. These conditions are fulfilled in all cases of production of low density products and in almost all cases of medium density products. The desired characteristics for the press plates of minimal mass and minimal thermal capacity plus good permeability and sufficient hardness and stiffness are met by using plates of much lower thickness than is conventional, for example less than one inch thick.

The advantages of consolidation under pressure using convection heat transfer are: significantly simpler and cheaper presses and significantly shorter consolidation periods, more uniform properties of resultant products, lower consolidation pressures, lower energy consumption, and reduction of air pollution by the use of closed system pressing.

In addition, when the material pressed comprises wood particles, a major contemplated use of the present invention, such particles used need not be excessively pre-dried by heating to 400°–450° F. Thus, an important advantage of the present invention is the possibility of heating consolidated products to much higher curing temperatures than 212° F. over short periods at elevated pressure without the necessity of drying out moisture from the product during consolidation. This advantage is an important one for bonding systems in accordance with Stofko, U.S. Pat. Nos. 4,107,379 and 4,183,999 or copending application Ser. No. 254,224 filed Apr. 14, 1981, now U.S. Pat. No. 4,357,194.

For example, in said copending application Ser. No. 254,224, it is disclosed that steam assists in the interaction between added carbohydrate and phenolic material either originally present or added, to produce a water-insoluble bond. Among the interrelationships disclosed are (1) steam plus carbohydrate wherein the material being bonded is a lignocellulosic material, the phenolic being the naturally occurring lignen; (2) steam plus carbohydrate plus phenolic; (3) steam plus carbohydrate plus phenolic plus acid catalyst; and (4) steam plus carbohydrate plus acidified phenolic. The carbohydrate is, as disclosed, a sugar, a starch or mixture thereof.

It is, accordingly, an object of the instant invention to overcome deficiencies in the prior art, such as indicated above.

It is another object to provide an improved method and apparatus for effecting consolidation of products under heat and pressure, using convection heating, and accomplishing the aforementioned advantages.

It is yet another object to produce composite products such as particle or fiberboard or plywood and the like in a simpler and less costly and more effective manner, and using less costly equipment.

These and other objects and the nature and advantages of the instant invention will be more apparent from the following detailed description, taken in conjunction with the drawing.

BRIEF DESCRIPTION OF THE DRAWING

FIG. 2 is a perspective view of an embodiment of a pressing plate in accordance with the present invention, and FIG. 2A is a section taken along the line A—A of FIG. 2;

FIG. 3 is a perspective view of another embodiment of a plate in accordance with the instant invention, FIG. 3A is a sectional view taken along line A—A of FIG. 3, and FIG. 3B is a sectional view taken along line B—B of FIG. 3;

DETAILED DESCRIPTION OF EMBODIMENTS

Figure 1:
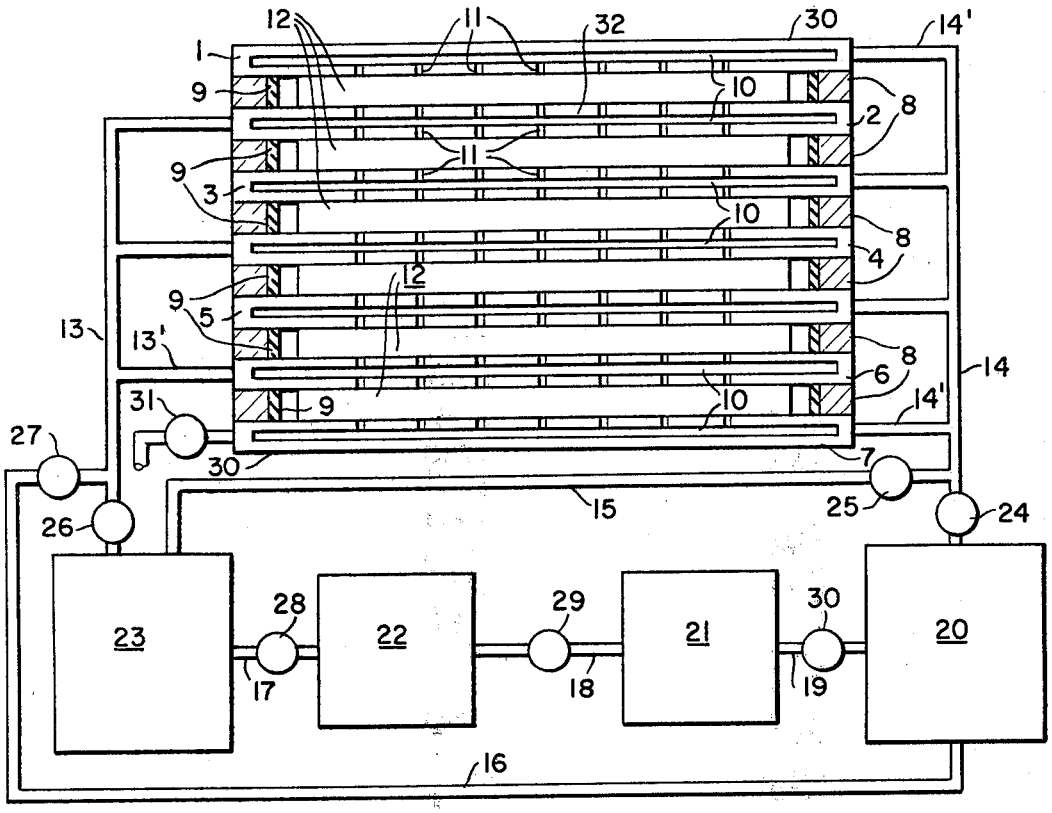
FIG. 1 is a schematic representation, partly in cross-section, of an apparatus in accordance with the invention.

The consolidation of products using the process and apparatus of the present invention is schematically illustrated in FIG. 1 which is a vertical sectional view through plural press plates of a multi-opening press loaded with pressed boards in the closed position. The upper press plate 1 and the lower press plate 7 are for one-side pressing, while the central press plates 2–6 are for two-side pressing. Each plate 1–7 is provided with horizontal permeability illustrated as a horizontal slot 10 in the area 30 of the periphery and the central area 32, and also with vertical permeabiltiy in the central area thereof as illustrated by vertical holes 11. It will be understood, however, that slots and holes are only an illustrative example of one of several possibilities of providing such horizontal and vertical permeability to the press plates.

Between adjacent press platens are provided stop bars 8 which control the distance at which press plates stop apart from one another and thus the product thickness. In the present invention such stop bars 8 are frames which extend circumferentially along the edges of the plates and which have means of sealing the space inside the frames, such sealing means comprising a heat-resistant elastomeric gasket material formed of a suitable heat-resistant rubbery material such as silicone rubber on each stop frame. The space lying between the press plates and inside the seals 9 constitutes the cavity for placement of the material, e.g. lignocellulosic material, which is to be consolidated under heat and pressure. It will be understood that the stop frames 8 and seals 9 as shown are exemplary only and constitute only one of several possibilities of providing spacing and gas-tight confinement of products between the press plates.

As noted in FIG. 1, the materials or products 12 to be consolidated cover the central, both horizontally and vertically permeable area of the press plates, e.g. the area 32 provided with both the vertical holes 11 and the horizontal slots 10, the latter of which extend into peripheral rim 30 having horizontal permeability only. It will be understood that the width or the length of central area 32 should be smaller than the width or length of the consolidated board to ensure that the steam or hot gas is forced to pass through the product and not around the product. The smallest difference between width and length of products and central area 32 is 3 times the product thickness.

It will also be understood that the vertical holes 11 should be spaced fairly closely together to insure good, uniform distribution into the product 12 of the hot gas or steam.

As shown in FIG. 1, the press plates 1, 3, 5 and 7 are connected by flexible hoses 14' to a hot fluid conduit 14, and press plates 2, 4 and 6 are connected via suitable flexible hoses 13' to the hot fluid conduit 13. The conduit 14 provides for communication between the press plates and a storage tank 20, and also through a conduit 15 with an exhaust tank 23. The conduit 13 provides for communication between the press plates and the exhaust tank 23, and also through the conduit 16 with the storage tank 20. Thus, for example, high pressure steam from a steam generator 22 passes through a conduit 18 into a superheater 21 and then to the storage tank 20. From storage tank 20, such superheated steam can be fed either through conduit 14 into plates 1, 3, 5 and 7, or alternatively through conduits 16 and 13 into plates 2, 4 and 6.

If hot, high pressure fluid is first fed into plates 1, 3, 5 and 7, the alternative plates 2, 4 and 6 serve for venting the hot fluid after it has passed through the product 12. Thus, steam injected into plates 1, 3, 5 and 7 passes from conduit 14 through flexible hoses 14' into the horizontal passageways 10 of the plates and from there through the vertical holes 11 and into the products 12; from there the steam passes through the vertical holes 11 of the plates 2, 4 and 6 pushing air before it out of the products 12 and the plate channels 10 and 11 and into the exhaust tank 23. The consolidation of the products 12 by pressure and heat transfer into the products 12 by convection proceeds in the pressing apparatus of the present invention as follows:

It is necessary to heat the press plates to the operating temperature by passage therethrough of heating fluid before the start of pressing, and therefore initially the press is closed by bringing the press plates into contact with the stop frames 8. Valves 24 and 26, along the lines 13 and 14, are opened and steam is passed through the conduit 14, the lines 14', the plates 1, 3, 5 and 7, the spaces between the plates, then through the plates 2, 4 and 6 and finally out through the lines 13' and the conduit 13 and into the exhaust tank 23. When the cool air originally present has been driven out and replaced by steam throughout the system, the valve 26 is partially closed so that only a slight bleeding of steam is allowed to thereby maintain the steam pressure in the plates corresponding to the desired plate temperature.

By contact with the initially cold press plates, steam will condense releasing heat of condensation for raising the plate temperature. This condensation will continue until the plates reach the temperature of the steam. Condensate accumulates in the bottom plate 7 from which it is periodically removed by opening a suitable drainage valve 31. When the press plate temperature reaches the desired level, the valve 24 is closed and a valve 25, along the line 15, is opened along with the valves 26 and 31 to release steam and condensate from the press plate.

Next, the heated presses are opened and the materials to be consolidated, e.g. lignocellulosic particles, are deposited on each of the plates to 2 to 7, it being understood that the materials to be consolidated will, in most cases, have been provided on their surfaces with a suitable bonding agent, such as disclosed in the aforementioned Stofko patents. After placement of the material to be consolidated on the presses, the presses are then moved together until they contact stops 8 as shown in FIG. 1. At this stage, the presses are essentially gas-tight with the materials to be consolidated confined therewithin.

High pressure steam from the steam generator 22 is then passed through the conduit 18 and into the super-heater 21 where it is heated to a higher temperature. From super-heater 21, the super-heated steam is then fed through a conduit 19 into the steam storage tank 20. By opening the valves 24 and 26 while maintaining valves 25, 27 and 28 closed (the latter valves 27 and 28 are located, respectively, in line 16 between line 13 and the storage tank 20 and line 17 between the exhaust tank 23 and the steam generator 22 along with valve 31, steam is fed through the conduit 14 and the lines 14' into the horizontal slots 10 of the plates 1, 3, 5 and 7, and from there through the vertical holes 11 into the products 12 being consolidated, and finally into the plates 2, 4 and 6 and the lines 13' and conduit 13.

If the curing temperature used is less than 250° F., such as for curing ureaformaldehyde resin, at the instant the steam enters the conduit 13 and open valve 26, resin reaches the curing temperature. At this instant value 24 can be closed and after a few additional seconds, depending on the reactivity of the resin, the curing process is completed and the process can be opened and boards removed. If higher than 250° F. temperatures are desired, e.g. if binders of higher curing temperature are used, the valve 26 is maintained open only until steam reaches the exhaust tank 23, at which time all air has been removed from the system. At that point, the valve 26 is closed and is maintained closed until the end of the steaming cycle. After closing the valve 26, the valve 27 may be optionally opened and steam passed through the conduit 13, the lines 13' and into the plates 2, 4 and 6 until the desired steam pressure is reached.

Simultaneously with increasing steam pressure in the products, hydraulic pressure increases proportionally. If the hydraulic pressure at any instant is lower than steam pressure, it being understood that the steam pressure serves to act against the hydraulic pressure, the seal becomes broken and steam escapes from between the press plates. On the other hand, if the hydraulic pressure is considerably higher than the steam pressure, excessive pressure on the stop frames may be imposed which may act to damage the press plates. Accordingly, it is understood that the hydraulic pressure must be controlled relative to the steam pressure and vice versa.

After the desired steam pressure in the products has been reached, the valves 24 and/or 27 are closed and the steam is maintained in the products 12 for a predetermined time to permit the completion of the consolidation process, this period being variable depending on the materials being consolidated and the nature of the bonding material. Normally, however, such a period is between 2 and 180 seconds, depending on the type of binder used. After such consolidation time has passed, the valves 25 and 26 are opened and the steam is released into the exhaust tank 23. During the depressurizing operation, the hydraulic pressure on the products 12 should be simultaneously decreased to maintain the steam and hydraulic pressures at about the same level, but acting in opposite directions against the plate, in order to avoid premature opening of the press which might result in damaging the products, or produce excessive pressure on the stops 8. When the steam gauge pressure has reached 0 in the products 12, the press is opened and the products removed from the presses. Heat in the condensate in the exhaust tank 23 can be used for preheating water for the steam generator 22.

Further improvements can be achieved if, together with the fluid heat carrier, other product-property-improving agents are transmitted into the products. As examples, fluid catalysts, stabilizing agents, plasticizers or other agents can be mentioned.

If high pressure steam is used as the heat carrier, the moisture content of the products during consolidation becomes increased due to steam condensation in the products 12. Because of this phenomenon, the moisture content before consolidation should be lower than the desired moisture content after consolidation. However, if the bonding mechanism of copending application, Ser. No. 254,224, is used, the starting lignocellulosic particles can be wetter than that permitted using conventional phenolic or urea-based adhesives.

If hot air or other gas is used as a heat carrier, the moisture content may be reduced during the consolidation and therefore the initial moisture content should be higher than the desired final moisture content.

If steam is used as a heat carrier, some condensation on the surface of the press plates will always occur even if the press plates have been preheated to the consolidation temperature, due to cooling by ambient air and cold material deposited into the press. As a result, consolidated material will be wetted on the surface during the initial stage of the steaming cycle. Such wetting is desirable because it makes surface layers more pliable and after consolidation the surface of the product is denser and smoother. However, such condensation can be reduced, to some extent, and heat losses similarly reduced by providing the plates, most particularly the outside surfaces of the plates 1 and 7, with an insulating coating, e.g. polytetrafluoroethylene or other fluorocarbon polymer, or silicone resin.

The pressing plates for heat transfer by convection according to the present invention can be made in a variety of ways, depending primarily on the required flexural rigidity and properties of the products 12 to be consolidated therewithin. The consolidation pressures in the production of low and medium density products vary widely from about 1 psi or even less in the production of low density insulation products, to 300 psi in the production of medium density particle boards. The lower the consolidation pressure, the lower the flexural rigidity required in the pressing plates. Also, the more uniform the material to be consolidated, the lower the flexural rigidity needed in the press plates. For example, plywood is more uniform than particle board, and therefore pressing plates in accordance with the present invention for pressing plywood can be less rigid than plates used for producing particle board.

One of several possible plate constructions is shown in FIGS. 2 and 2A. Here a pressing plate 41 is formed by a laminate of an upper perforated sheet metal plate 42, a lower perforated sheet metal plate 43 and with a screen 44 placed therebetween. The two sheet metal plates 42 and 43 of about ⅜ inch thickness are welded together along the edges thereof to provide a unitary body. The edge area 30 of the plate, not being perforated, possesses only horizontal permeability which is provided by the metallic screen 44 between the sheet metal plates 42 and 43. The perforated central area possesses both horizontal and vertical permeabilaity, the latter of which constitutes the vertical perforations 11 in the central area 21 of the sheet metal plates 42 and 43. Along the edges on the bottom surface of the plate 41 is provided a stop frame 8, carrying a suitable flexible and heat-resistant seal 9, e.g. of silicone rubber. Steam is fed to the horizontal internal slot, partially occupied by the screen 44, through the suitable pipe of flexible hose 13'.

Another pressing plate construction 51 is shown in FIGS. 3, 3A and 3B. The plate 51 is formed from a series of rectangular bars 53 mounted together with narrow gaps 54 therebetween, such gaps 54 serving as passageways for horizontal and vertical permeability. Holding the bars 53 together along the peripheral area 30 and serving to close off the vertical permeability in such area 30 are suitable rectangular "picture-frame" sheet metal plates 56, or sheet metal strips 56 covering the bars along the edges from all sides and welded together and the bars 53. Along two edges at opposite ends of the bars 53 are provided two open channels 55 serving to permit the steam to enter and leave the slots 54. On the bottom surface along the edges are provided, as is usual, the stop frames 8 carrying flexible seals 9. Again the flexible hose or pipe 13' communicates with the channels 55 from an outside source of heat carrier.

Figure 4:
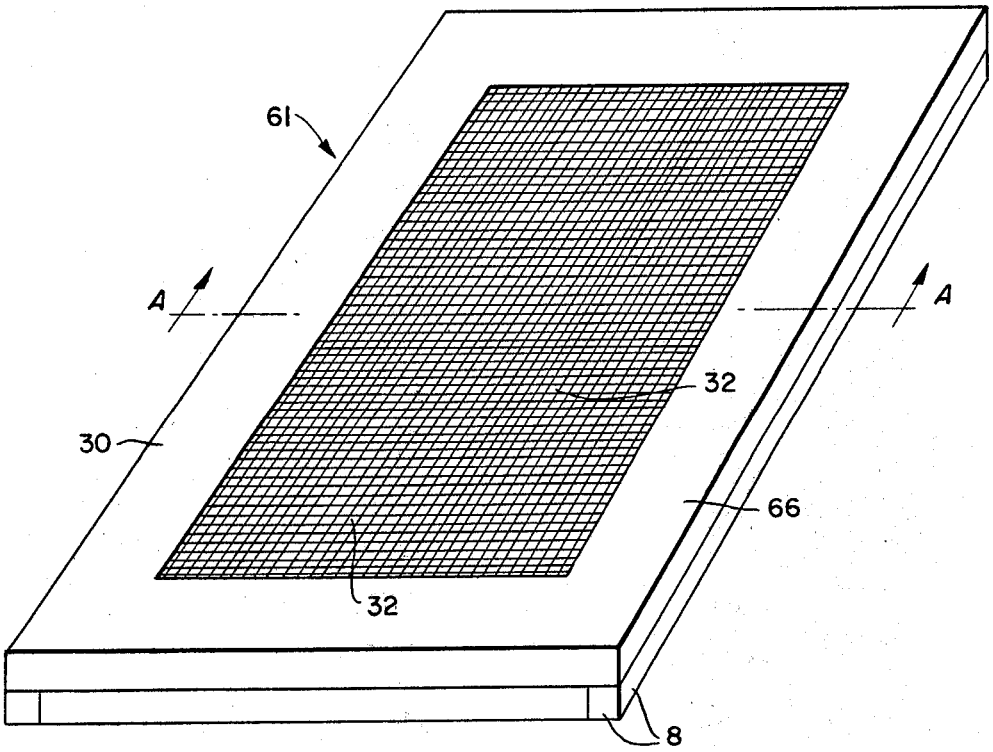
FIG. 4 is a perspective view of yet another embodiment of a press plate according to the invention.
Figure 4A:
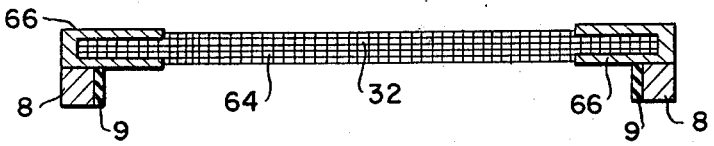
FIG. 4A is a section taken along line A—A of FIG. 4.

FIGS. 4 and 4A show another embodiment 61 in which the central area 32 is formed of preferably a plurality of wire screens or wire cloth 64 and the peripheral edge area 30, like in the FIG. 3 embodiment, comprises a plurality of sheet metal strips 66 welded together. As in the other embodiments, a stop frame 8 is provided peripherally on the bottom surface along the edges, the stop frame 8 carrying on its inner surface a suitable flexible seal 9. The plate 61 is of low flexural rigidity and is suitable for the manufacture of low density products or plywood.

Figure 5:
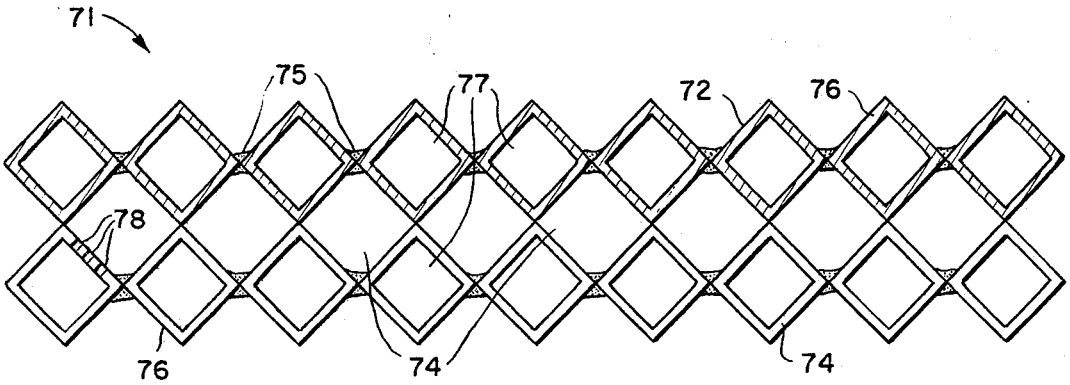
FIG. 5 is a cross-section of another embodiment taken through two press plates with a set of products therebetween.

Instead of flat plates for the consolidation of substantially flat composite products, press plates in accordance with the present invention can be provided for producing consolidated shaped products using pressure and convection heating. An example of a pressing plate 71 in accordance with the present invention for the consolidation of rods of square cross-section is shown in FIG. 5, comprising an upper press plate 72 and a lower press plate 73, defining therebetween, when in closed position, a series of cavities of rectangular cross-section for forming therewithin a series of consolidated bars 74 of square cross-section. Each of the plates 72 and 73 are formed of a series of hollow tubes or pipes 76 of square cross-section welded together along opposite edge corners 75 to produce what in essence is a die for die forming of rectangular bars 74. The hollow interiors 77 of the square tubes or pipes 76 serve as passageways for horizontal permeability. The walls of each of the rectangular pipes 76 are provided with holes 78 (illustrated in only one said pipe for purposes of simplicity) for vertical permeability of the central area. Using this principle, a variety of molded products in a wide range of sizes can be produced.

Vertical permeability of the central area 32 of the plates can be open in both directions, in the case of pressing plates used for two side pressing such as plates 2 and 3 in FIG. 1; or only in one direction for one side pressing as is the case for plates 1 and 7 in FIG. 1. It will be understood that with regard to embodiments such as shown in FIGS. 2–4, plates with restricted vertical permeability in one direction, corresponding to the plates 1 and 7 in FIG. 1, can be produced by using for the surface to be closed unperforated sheet metal.

It will be understood that an important feature of the pressing plates of the instant invention is the concept of the provision of both horizontal and vertical permeability to the heating fluids. The edge area 30 should be only horizontally permeable while the central area 32 is both horizontally and vertically permeable. The function of the edge area 30 is to receive the heat carrier from the outside source and to distribute it along the total edge area inside the plate in a short time. The function of the central area 32 is to receive the hear carrier from the edge area 30 and distribute it in the shortest possible time vertically into the consolidated product covering the central area.

Consolidation temperatures of wide range can be used for heat transfer by convection according to the invention. If steam is used as the heat carrier, the consolidation temperature will be determined by the steam pressure. Wide ranges of steam pressure can be provided according to current technology. Depending on the desired speed of the consolidation, and the nature of the material to be consolidated and the bonding agent used, steam pressure from barely above atmospheric, e.g. 15–20 psi up to 500 psi will normally be used. The speed of heat transfer by convection is dependent on the temperature of the heat carrier and on the speed of injection. The higher the open area of plates and area of conduits for communication of heat carriers, the higher the speed of heat carrier and release. Heat transfer by convection is almost independent of product thickness, and very short consolidation periods are achievable, in from 20 to 300 seconds, for even very thick products.

It is to be understood that the invention is not limited to the embodiments disclosed which are illustratively offered and that modifications may be made without departing from the invention. For example, a plate in accordance with the instant invention may be used in conjunction with a conventional press platen using heat transfer by conduction. The plates and their component parts can be made of other materials, such as suitably heat-resistant plastomers or elastomers which are not unduly flexible.

The foregoing description of the specific embodiments will so fully reveal the general nature of the invention that others can, by applying current knowledge, readily modify and/or adapt for various applications such specific embodiments without departing from the generic concept and, therefore, such adaptations and modifications should and are intended to be comprehended within the meaning and range of equivalents of the disclosed embodiments. It is to be understood that the phraseology or terminology employed herein is for purposes of description and not of limitation.

What is claimed is:

1. In a method of forming a product of low to medium density by consolidation of fibrous, particulate or laminar materials in the presence of a bonding agent, under heat and pressure, the improvement wherein said materials are pressed in a closed, sealed press and heated substantially entirely by the direct passage thereinto of a fluid heat carrier at superatmospheric pressure and having a temperature sufficient to plasticize said materials and to heat the bonding agent to a temperature at which consolidation of said materials occurs, said heating being carried out for a time sufficient to effect complete consolidation of said materials, said heat carrier being distributed uniformly to said materials through one side thereof or through opposite sides, and (1) passed out therefrom also along one or opposite sides, or (2) said fluid heat carrier being left within said materials for a time sufficient to permit it to expand therein to atmospheric pressure.

2. A method according to claim 1 wherein said fluid heat carrier is steam.

3. A method according to claim 1 wherein said fluid heat carrier is initially distributed uniformly to said materials during a period of time of less than 60 seconds to reach equilibrium, said heat fluid is then maintained within said closed, sealed press until consolidation of said materials is substantially completed by the action of said bonding agent, and then said fluid heat carrier is released from said press.

4. A method according to claim 1 wherein said fibrous, particulate or laminar material comprises wood particles.

5. A method according to claim 2 wherein said fibrous, particulate or laminar material comprises wood particles containing about 10–30% water.

6. A method according to claim 1 wherein said press is relatively flexible compared to conventional presses and hydraulic pressure progressively applied to said press externally is matched with fluid heat carrier pressure progressively applied to the press internally.

7. A method according to claim 1 wherein said fluid heat carrier is passed through said material from one side to the opposite side thereof for a time sufficient to heat said bonding agent to the consolidation temperature.

8. A method according to claim 1 wherein said fluid heat carrier contains an adjuvant agent for improving properties of a consolidated product.

9. A method according to claim 2 wherein said steam is passed into said material along one or both sides and let to expand therein to atmospheric pressure.

10. In an apparatus for forming porous products of low to medium density by consolidation of fibrous, particulate or laminar materials in the presence of a bonding agent, under heat and pressure, and comprising a press and at least one pair of pressing plates between which the consolidation of such materials is effected, the improvement wherein a peripheral seal surrounding the space between said pair of pressing plates when said plates are closed to press therebetween the materials to be consolidated to provide a sealed, closed pressing volume, at least one of said pair of pressing plates having horizontal permeability along substantially its entire interior and having vertical permeability along a central portion thereof, said pressing plate being relatively flexible, said pressing plates being thin, and of low mass and thermal capacity;

and means to apply a fluid heat carrier to the interiors of one of said pressing plates for passage of said heat carrier through the vertical permeability thereof.

11. Apparatus according to claim 10 wherein each said pressing plate has a thickness not substantially greater than about 1 inch.

12. Apparatus according to claim 10 comprising means to progressively apply hydraulic pressure to said press externally to force said pair of pressing plates together to squeeze therebetween the materials to be consolidated while matching said external hydraulic pressure with fluid heat carrier pressure progressively applied to said pressing plates internally.

13. Apparatus according to claim 10 wherein each of said pressing plates comprises a pair of sheet metal plates spaced apart and sealed about the periphery thereof.

14. Apparatus according to claim 13, wherein said space between said spaced-apart sheet metal plates is filled with one or more porous screens or wire cloths.

15. Apparatus according to claim 10 wherein each pressing plate is formed of a plurality of spaced-apart bar members with an impervious peripheral frame thereabout.

16. Apparatus according to claim 10 wherein each of said pressing plates comprises a plurality of screens or wire cloths, the edge portions of which are surrounded by a peripheral impervious frame.

17. An apparatus for consolidating solid lignocellulosic materials and forming a bonded product therefrom comprising:

upper and lower press platens forming a cavity therebetween;

sealing means about said cavity to define a closed, gas-tight space between said upper and lower platens;

means to place within said cavity the solid lignocellulosic material having on a surface thereof an adhesive-free bonding material comprising at least one sugar, starch or mixture thereof;

means to move said upper and lower platens together to squeeze the solid lignocellulosic material together and to engage said sealing means to provide said closed, gas-tight space with the lignocellulosic material therein;

means to feed live steam to the sealed area between said platens along substantially the entire area of said platens within the space defined by said sealing means;

means to maintain said live steam within the sealed space for a time sufficient to generate natural catalysts and to activate phenolic material on the lignocellulosic material and to react such phenolic with the sugar, starch or mixture thereof, and thereby produce a waterproof bonded product; and means to subsequently release the steam.

18. Apparatus according to claim 17, wherein said means for feeding steam comprises a steam pipe for feeding live steam from an outside source to the space between said platens and a steaming plate comprising a steam force element through which said steam is passed into the pressing space between said platens from said steampipe.

* * * * *